US008348700B1

(12) United States Patent
Chiang

(10) Patent No.: US 8,348,700 B1
(45) Date of Patent: Jan. 8, 2013

(54) CABLE CONNECTOR HAVING A METALLIC SHIELD SLIDABLY DISPOSED IN A GROOVE

(75) Inventor: Chih-hsien Chiang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/239,477

(22) Filed: Sep. 22, 2011

(51) Int. Cl.
*H01R 13/648* (2006.01)

(52) U.S. Cl. ..... 439/607.08

(58) Field of Classification Search ..... 439/607.05, 439/607.08, 342, 159
See application file for complete search history.

(56) References Cited

U.S. PATENT DOCUMENTS 4,698,552 A * 10/1987 Minami et al. ..... 315/82
5,511,993 A * 4/1996 Yamada et al. ..... 439/607.5
6,780,058 B2 * 8/2004 Mizumura et al. ..... 439/607.08
7,033,190 B1 * 4/2006 Chen ..... 439/159
D655,248 S * 3/2012 Chiang ..... D13/146
2003/0092305 A1 * 5/2003 Takeuchi ..... 439/342

* cited by examiner

*Primary Examiner* — Chandrika Prasad
(74) *Attorney, Agent, or Firm* — Cheng-Ju Chiang

(57) ABSTRACT

A cable connector is disclosed. The cable connector includes a male connector, a female connector, and a metallic shield. The male connector includes a male base and a plurality of male terminals received in the male base. The female connector includes a female base and a plurality of female terminals received in the female base. The male terminals embed in the female terminals. The metallic shield is slidably disposed in the female connector. The metallic shield is attachable to or detachable from the female connector. Since the male connector is covered by the metallic shield for positioning the male connector in the female connector, the male base and the female base are not worn after the female connector and the male connector are attached and detached many times. Accordingly, the male terminals and the female terminals contact well with each other to ensure the performance of the cable connector.

3 Claims, 4 Drawing Sheets

CABLE CONNECTOR HAVING A METALLIC SHIELD SLIDABLY DISPOSED IN A GROOVE

BACKGROUND OF THE INVENTION

1. Field of the Invention

The present invention generally relates to a connector, and more particularly to a cable connector.

2. Description of Prior Art

Nowadays, many electrical products comprise a plurality of circuit boards disposed therein. A plurality of pins is disposed on each of the circuit boards for transmitting signals between two of the circuit boards. Cables are electrically connected to the pins of the two circuit boards to achieve the purpose of transmitting signals.

To assemble or disassemble the two of the circuit boards conveniently, a cable connector is employed. Currently, a conventional cable connector is composed of a male connector and a female connector. A male connector comprises an insulative base and a plurality of male terminals received in the insulative base. A female connector comprises an insulative base and a plurality of female terminals received in the insulative base. One end of each of the male terminals and one end of each of the female terminals are respectively connected to the circuit board by the cables. The other one end of each of the male terminals embeds in the other one end of each of the female terminals. As a result, the male connector and the female connector are electrically connected, and thus the two of the circuit boards are electrically connected.

Usually, plastics for manufacturing the insulative base of the male connector and plastics for manufacturing the female connector are designed to ensure the performance of the cable connector after the male connector embeds in the female connector. However, after the male connector and the female connector are attached and detached many times, the plastics are worn so that retention between the male connector and the female connector is decreased. Finally, the retention between the male connector and the female connector loses effectiveness. Accordingly, the male terminals and the female terminals cannot contact well with each other, and the performance of the cable connector is affected.

Thus, there is a need to provide an improved cable connector so that the male terminals and the female terminals contact well with each other to ensure the performance of the cable connector even if the male connector and the female connector are attached and detached many times.

SUMMARY OF THE INVENTION

To solve the above-mentioned deficiencies in the prior arts, an objective of the present invention is to provide a cable connector so that the male terminals and the female terminals contact well with each other to ensure the performance of the cable connector even if the male connector and the female connector are attached and detached many times.

To implement the above-mentioned objective, the cable connector in accordance with to an aspect of the present invention comprises a male connector and a female connector. The male connector comprises a male base and a plurality of male terminals received in the male base. The female connector comprises a female base and a plurality of female terminals received in the female base. The male terminals embed in the female terminals. The cable connector further comprises a metallic shield, the metallic shield is slidably disposed in the female connector, and the metallic shield is attachable to or detachable from the female connector.

Furthermore, two slide grooves are respectively defined in two sides of the female base. A first concave slot and a second concave slot are defined in a groove bottom wall of each slide groove. Two protrusions respectively protrude from two inner side walls of the metallic shield. When the metallic shield slides along the female base, the protrusions respectively slide in the corresponding slide grooves and lock in the corresponding first concave slots or the second concave slots.

Furthermore, two locking slots are respectively defined in the two sides of the female base, and two locking parts are respectively formed in two sides of the metallic shield. When the metallic shield which is disposed in the female base slides, the locking parts and the locking slots are locked or unlocked.

Furthermore, a plurality of terminal slots is respectively defined in the male base and the female base, the male terminals are received in the corresponding terminal slots of the male base, and the female terminals are received in the corresponding terminal slots of the female base.

Compared with the prior arts, the cable connector in accordance with the present invention comprises the metallic shield. The metallic shield is slidably disposed in the female connector, and the metallic shield can be attachable to or detachable from the female connector. Since the male connector is covered by the metallic shield for positioning the male connector in the female connector, the male base and the female base are not worn after the female connector and the male connector are attached and detached many times. As a result, the male terminals and the female terminals contact well with each other, so as to ensure the performance of the cable connector.

DETAILED DESCRIPTION OF THE INVENTION

Figure 1:
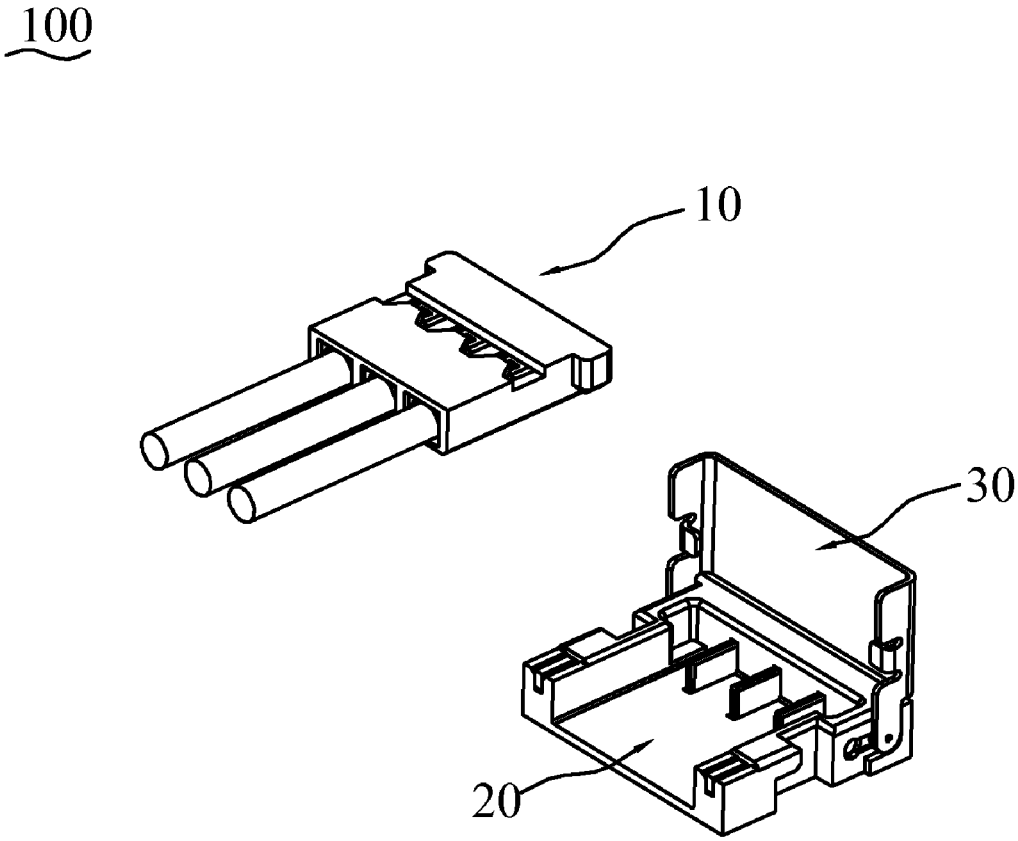
FIG. 1 is a perspective view of a cable connector in accordance with one embodiment of the present invention.

Please refer to FIG. 1, a cable connector 100 in accordance with the present invention comprises a male connector 10, a female connector 20, and a metallic shield 30. The male connector 10 embeds in the female connector 20 for implementing the electrical connection between the male connector 10 and the female connector 20. The metallic shield 30 is slidably disposed in the female connector 20, and the metallic shield 30 is attachable to or detachable from the female connector 20.

Figure 2:
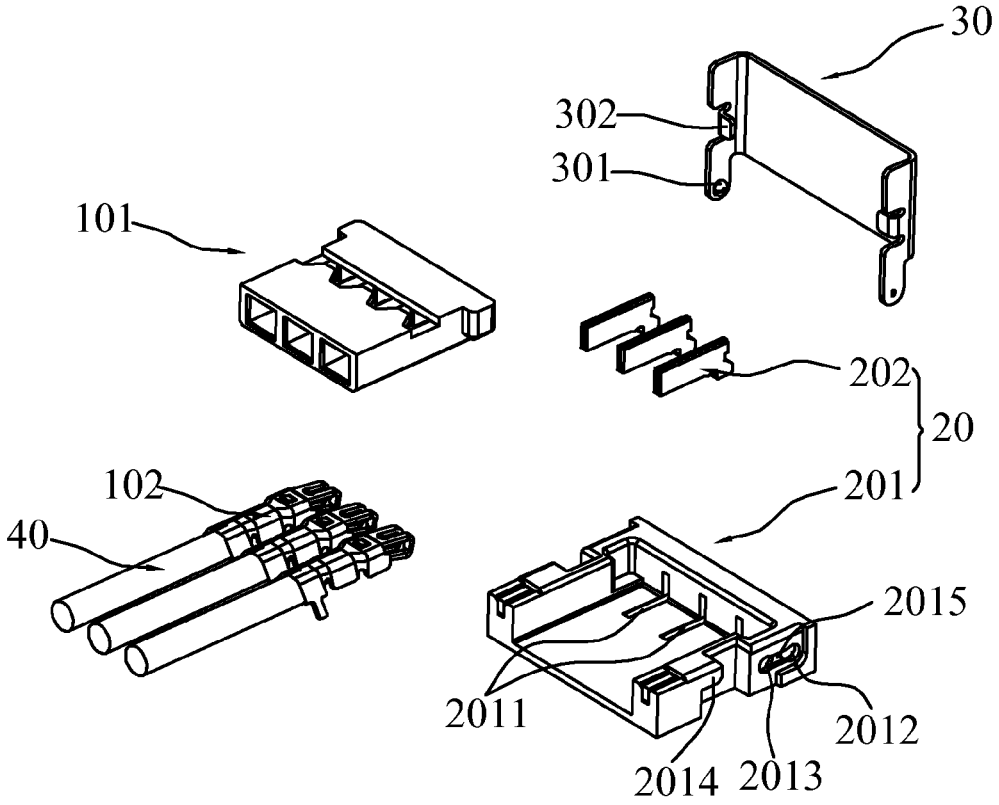
FIG. 2 is an exploded view of the cable connector in accordance with the present invention.
Figure 3:
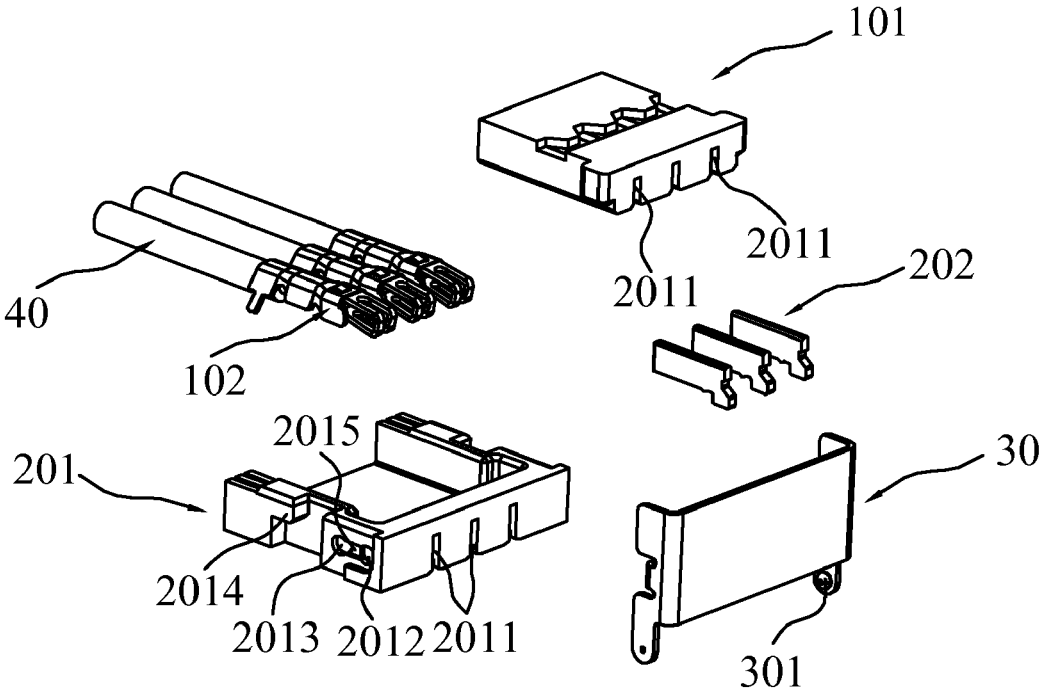
FIG. 3 is a perspective view of the cable connector from another angle in accordance with the present invention.

Particularly, referring to FIGS. 2 and 3, the male connector 10 comprises a male base 101 and a plurality of male terminals 102. The male terminals 102 are received in the male base 101. The female connector 10 comprises a female base 201 and a plurality of female terminals 202. The female terminals 202 are received in the female base 201. One end of each male terminal 102 is a contacting part (not numbered), and the other one end of each male terminal 102 is a welding part (not numbered). One end of each female terminal 202 is a contacting part (not numbered), and the other one end of each female terminal 202 is a welding part (not numbered). The welding part of each male terminal 102 is connected to a cable 40. The contacting part of each male terminal 102 embeds in the contacting part of each corresponding female terminal 202. The welding part of each female terminal 202 is welded on a circuit board.

Particularly, a plurality of terminal slots 2011 is defined in both the male base 101 and the female base 201. The male terminals 102 and the female terminals 202 are respectively received in the corresponding terminal slots 2011 of the male base 101 and the female base 201.

Furthermore, two slide grooves 2015 are respectively defined in two sides of the female base 201 (only one side of the female base 201 is shown in FIGS. 2 and 3). Two locking slots 2014 are respectively defined in the two sides of the female base 201 (only one side of the female base 201 is shown in FIGS. 2 and 3). A first concave slot 2012 and a second concave slot 2013 are defined in a groove bottom wall of each slide groove 2015. Two protrusions 301 respectively protrude from two inner side walls of the metallic shield 30 (only one protrusion 301 is shown in FIGS. 2 and 3). Two locking parts 302 are respectively formed in two sides of the metallic shield 30 (only one locking part 302 is shown in FIG. 2). When the metallic shield 30 correspondingly slides along the female base 201, the two protrusions 301 respectively slide in the corresponding slide grooves 2015 to be locked in the corresponding first concave slots 2012 or second concave slots 2013. The locking parts 302 and the locking slots 2014 are locked or unlocked.

Figure 4:
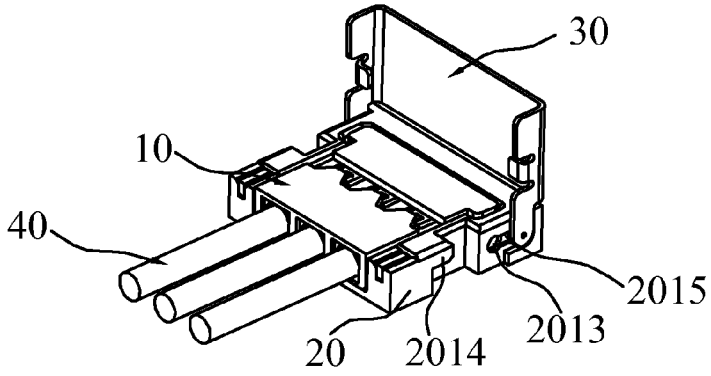
FIG. 4 is a perspective view showing that a metallic shield is opened after a male connector embeds in a female connector.
Figure 5:
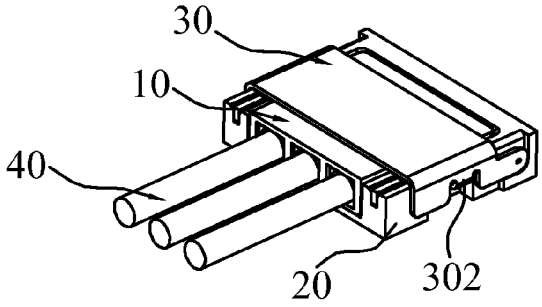
FIG. 5 is a perspective view showing that the metallic shield covers the female connector in FIG. 4.
Figure 6:
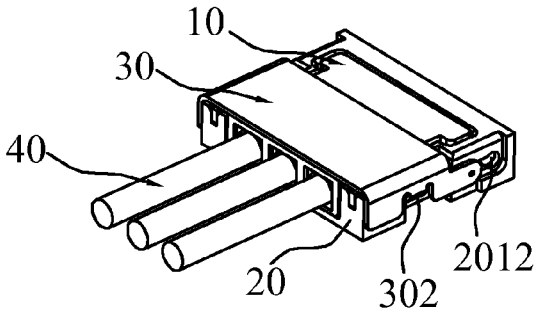
FIG. 6 is a perspective view showing that the metallic shield and the female connector are locked after the metallic shield slides forwardly in FIG. 5.

Referring to FIGS. 4, 5, and 6, which show use states of the metallic shield 30 in accordance with the present invention. When the metallic shield 30 disposed on the female base 201 is operated in an opening state, the male connector 10 is detachable from the female connector 20 and the protrusions 302 of the metallic shield 30 are locked in the corresponding first concave slots 2012. Then, the metallic shield 30 covers the female connector 20, and the metallic shield 30 slides forwardly so that the protrusions 301 slide along the corresponding slide grooves 2015 and are locked in the corresponding second concave slots 2013. The locking parts 301 of the metallic shield 30 are locked in the corresponding locking slots 2014 of the female connector 20, thereby locking and positioning the metallic shield 30. As a result, the metallic shield 30 cannot be opened, and the retention of the metallic shield 30 can be implemented after the male connector 10 and the female connector 20 are attached. In contrast, when the male connector 10 is required to be detached, the metallic shield 30 slides backwardly so that the locking parts 302 and the locking slots 2014 are unlocked. When the protrusions 301 are locked in the first concave slots 2012 again, the male connector 10 can be detached.

As mentioned above, the metallic shield 30 is slidably disposed in the female connector 20, and the metallic shield 30 can be attached to or detached from the female connector 20. Since the male connector 10 is covered by the metallic shield 30 for positioning the male connector 10 in the female connector 20, the male base 101 and the female base 201 are not worn after the female connector 20 and the male connector 10 are attached and detached many times. As a result, the male terminals 102 and the female terminals 202 contact well with each other, so as to ensure the performance of the cable connector 100.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A cable connector, comprising a male connector and a female connector, the male connector comprising a male base and a plurality of male terminals received in the male base, the female connector comprising a female base and a plurality of female terminals received in the female base, the male terminals embedding in the female terminals, wherein the cable connector further comprises a metallic shield, the metallic shield is slidably disposed in the female connector, and the metallic shield is attachable to or detachable from the female connector wherein two slide grooves are defined in two sides of the female base, a first concave slot and a second concave slot are defined in a groove bottom wall of each slide groove, two protrusions protrude from two inner side walls of the metallic shield, when the metallic shield slides along the female base, the protrusions slide in the slide grooves and lock in the first concave slot or the second concave slot.

2. The cable connector as claimed in claim 1, wherein two locking slots are respectively defined in the two sides of the female base, two locking parts are respectively formed in two sides of the metallic shield, when the metallic shield which is disposed in the female base slides, the locking parts and the locking slots are locked or unlocked.

3. The cable connector as claimed in claim 1, wherein a plurality of terminal slots is respectively defined in the male base and the female base, the male terminals are received in the corresponding terminal slots of the male base, and the female terminals are received in the corresponding terminal slots of the female base.

* * * * *